United States Patent [19]

Gruaz

[11] 4,173,089

[45] Nov. 6, 1979

[54] AMMUNITION FOR A TOY PISTOL

[76] Inventor: Eric Gruaz, 4 Avenue Marechal Foch, Lyon, France

[21] Appl. No.: 849,251

[22] Filed: Nov. 7, 1977

[30] Foreign Application Priority Data

Nov. 8, 1976 [FR] France ..... 76 34375

[51] Int. Cl.[2] ..... F41C 3/06; F42B 4/24

[52] U.S. Cl. ..... 42/58; 102/281

[58] Field of Search ..... 102/281; 42/58

[56] References Cited

U.S. PATENT DOCUMENTS 3,999,485 12/1976 Ferri ..... 102/281

FOREIGN PATENT DOCUMENTS 1236384 3/1967 Fed. Rep. of Germany ..... 102/281

588986 2/1959 Italy ..... 42/58

*Primary Examiner*—Verlin R. Pendegrass

*Attorney, Agent, or Firm*—Karl F. Ross

[57] ABSTRACT

Ammunition for a toy revolver comprises a disk structure provided with a plurality of angularly equispaced capsules containing explosive charges (rounds) and adapted to register with anvils of a barrel for firing. The number of capsules is twice that of the number of seats within which each of the anvils is provided. The side of the disk opposite the percussion side is formed with at least two projections each of which is adapted to engage in one of the seats between a wall thereof and the anvil. Thus the projections lie to one side of the anvil during the firing of alternate capsules and the disk can be angularly spaced relative to the barrel to dispose the projections on the opposite sides of the respective anvils and cause the remaining capsules to be aligned with the anvils and to be fired.

5 Claims, 5 Drawing Figures

AMMUNITION FOR A TOY PISTOL

FIELD OF THE INVENTION

The present invention relates to ammunition for a toy pistol of the revolver type and, more particularly, to disk-type multi-round munitions for such toy pistols which have a larger number of firing capsules than barrel seats.

BACKGROUND OF THE INVENTION

In French Pat. No.1 437 592 there is described a disk-shaped ammunition unit for a toy revolver, i.e. a toy pistol having a rotating barrel, which comprises on one face of an annular disk a plurality of cylindrical capsules containing explosive charges (rounds) and adapted to be aligned or register with seats or recesses formed in the barrel. Within each seat, there projects toward the munition disk, a respective anvil which can have a point and which can engage the side of the disk opposite the percussion side. In the system of that patent, the number and distribution of the cylindrical explosive-charge capsules corresponds to the number and distribution of the seats.

During the use of a gun or pistol of this type, each operation of the trigger causes the firing of one capsule by the hammer and the rotation of the barrel through a fraction of a revolution corresponding to the angular spacing between two capsules.

It should be mentioned that a system in which the disk is turned over after the firing of alternate capsules, e.g. even numbered capsules, to enable the firing of the remainder, namely, the odd-numbered capsules, are inconvenient. Such arrangements, moreover, require special pistols and are not suitable for use with commercially available revolvers of the present type.

OBJECTS OF THE INVENTION

It is the principal object of the present invention to provide a disk-type ammunition for a toy pistol of the revolver type in which the number of explosive-charge capsules or units (rounds) is equal to twice that of the seats of the pistol in which the munition is to be received.

Another object of the invention is to eliminate problems with respect to the use of munitions which have hitherto required that the munition disk be turned over to fire the additional number of explosive charges.

SUMMARY OF THE INVENTION

These objects are attained, in accordance with the invention, in a munition disk adapted to be placed in a toy revolver in engagement with a barrel having a plurality of angularly equispaced seats or recesses at the center of which respective anvils project toward the disk, the disk being formed on its face opposite that to be engaged by the hammer with at least two projections, each of which is adapted to engage in one of the seats to one side or the other of the respective anvil. Thus, alternate explosive-charge capsules of the disk are aligned with, i.e. register with, the anvils in a position of the projections to one side of the anvils of the seats in which these projections engage. To fire the remaining explosive-charge capsules, one merely shifts the disk angularly relative to t the barrel to dispose the respective projections to the opposite side of each anvil previously flanked thereby but within the same barrel seat, thereby aligning the remainder of the explosive-charge capsules with the anvils and enabling the firing thereof by the hammer upon rotation of the barrel in the manner previously described.

According to a feature of the invention, the disk-shaped munition comprises a two-part annular disk with the two parts being assembled together and being composed of synthetic resin or plastic material or another material which can be thermally bonded to the opposite disk. One of the disk elements comprises an array of axially open cylindrical recesses uniformly angularly spaced about the axis of the disk and terminating in a face of this disk element. The projections previously mentioned are provided on the opposite face.

Each of these recesses contains a respective explosive charge forming one of the capsules previously mentioned, the other disk element sealingly engaging the face of the first disk element at which the recess is open and thereby closing these capsules. The latter disk element can be composed of a flexible material, e.g. paper or foil so as to be readily deformable by the hammer of the toy weapon.

According to still another feature of the invention, the two projections are angularly spaced about the axis and are diametrically disposed. However, when more than two such projections are provided, they are angularly equispaced about the axis so that, in the case of three projections they are separated by a center-to-center spacing of 120°.

According to an important part of the invention, the diameter of each of the explosive-charge capsules is equal or slightly greater than that of the anvil.

In yet another feature of the invention, each of the projections has a width such that, when added to the radius of the cylindrical anvil, the sum corresponds to the angular spacing of two neighboring capsules.

It is also an important feature of the invention that the radial dimension of each of the aforementioned projections, which can be elongated, in the radial direction, is such that each projection can be forcibly engaged in a respective seat of the barrel to one side or the other of the corresponding anvil. Each projection is, moreover, disposed between two neighboring capsules in such manner that the capsule to either side of each projection is aligned with a respective anvil in each position of the projection within the seat, i.e. disposed to a clockwise or counterclockwise side of the anvil.

Consequently, half of the capsules, i.e. one out of two, is axially aligned with respective anvils in the one position of the projections while the other half, i.e. the remaining capsules, register with the anvil in the other position of the projections.

Consequently, once the munition is placed on the barrel of the revolver, the user is able to fire half of the capsules or rounds through one revolution of the disk, i.e. alternate capsules are fired. In order to fire the remainder, i.e. each unfired capsule between fired capsules, it suffices to angularly displace the disk relative to the barrel by disposing the projections on the opposite side of each anvil within the same seat in which the projection was originally disposed.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
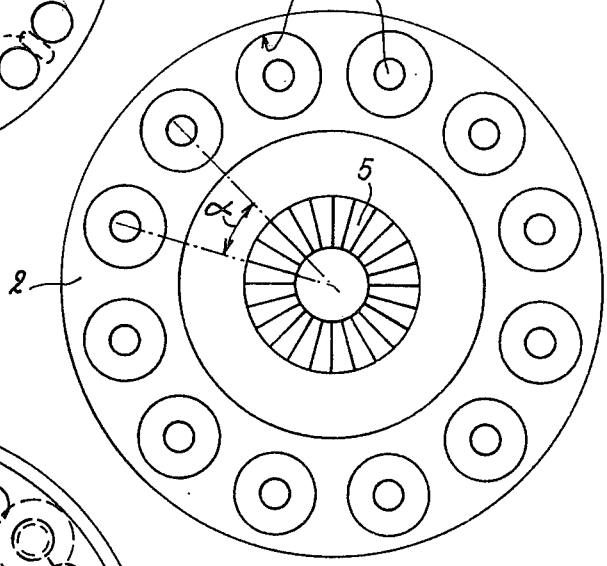
FIG. 3 is a view of the rear face of a barrel of a conventional toy pistol adapted to be used with the munition of FIGS. 1, 2, 4 and 5.

The revolver barrel 2 illustrated in FIG. 3 is of conventional type and thus comprises, toward its periphery, twelve cylindrical seats 3 (concavities) each of which is formed centrally with an anvil 4 pointed in the direction of the munition disk. These seats are adapted to receive or be aligned with individual firing capsules of conventional design or capsules mounted upon an annulus, i.e. disk-shaped munitions. The center of the barrel 2 is formed with a star-shaped array of teeth 5 adapted to engage and rotate the disk through a fraction of a revolution corresponding to the angular displacement and between two neighboring seats (FIG. 3).

Figure 2:
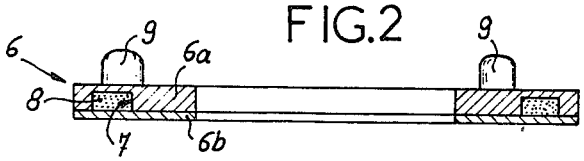
FIG. 2 is a diametrical cross-sectional view through the munition disk according to the invention.

The munition disk, according to the invention, is represented generally at 6 and comprises two disk elements 6*a* and 6*b* adapted to be thermally bonded together as has been illustrated somewhat diagrammatically in FIG. 2. The disks 6*a* and 6*b* can be composed of a synthetic-resin (plastic) material or the like. The thinner disk 6*b*, however, is preferably constituted of a metal foil, cardboard or paper or other flexible material treated in a manner as to make it thermally weldable to the thicker disk element 6*a*.

The latter disk element 6*a*, on its face adapted to be bonded to the percussion element 6*b*, is formed with cylindrical recesses 7 each of which can contain an explosive charge 8 such that the explosive charges within the recesses each constitute a capsule adapted to explode upon impact by a hammer against the anvil. The capsules are closed along this surface by the element 6*b*.

Figure 4:
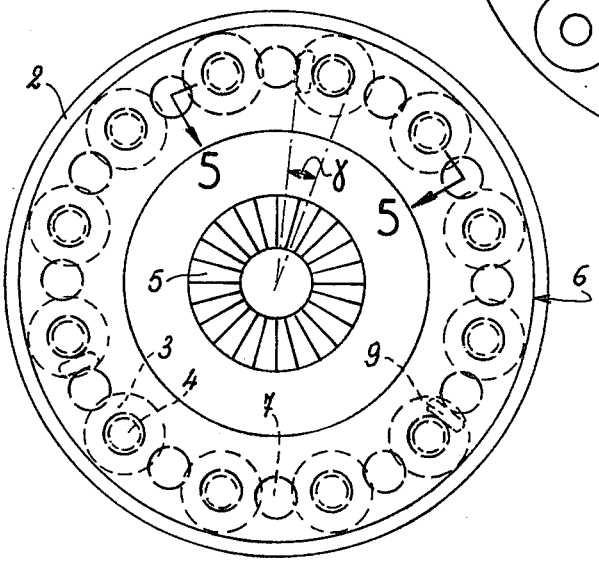
FIG. 4 is a view similar to FIG. 3 after the munition disk has been disposed on this barrel.
Figure 5:
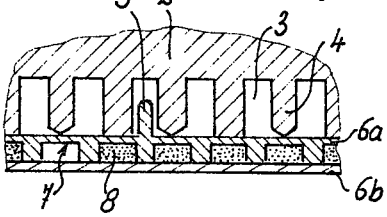
FIG. 5 is a cross-sectional view taken along the line V—V of FIG. 4 in developed configuration.

On its opposite face, the disk element 6*a* carries at least two projections 9 although three projections angularly equispaced by 120° from one another are preferred as has been shown in FIG. 4. Each projection is radially elongated (FIG. 4) and is disposed between two recesses 7 or capsules 8.

Figure 1:
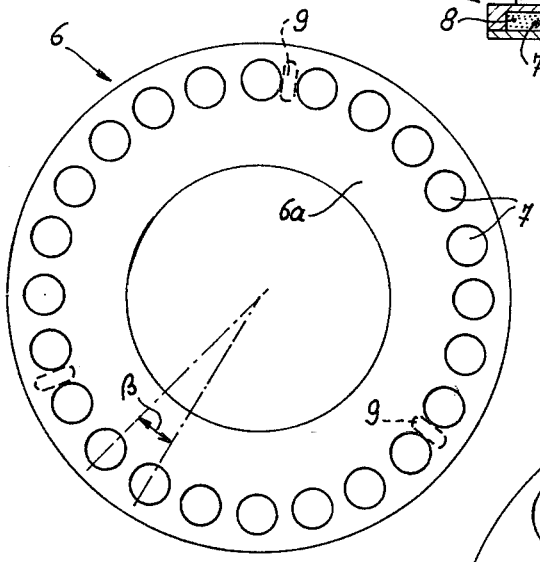
FIG. 1 is a plan view of an embodiment of the munition disk before the closure-disk element is applied to the disk element formed with the capsule-receiving recesses.

As a comparison of FIGS. 1–3 with FIG. 4 will show, the munition disk 6 comprises two times as many capsules 8 as the barrel 2 has seats 3. Thus, the disk 6 can have 24 capsules with an angular spacing $\beta$ between two neighboring capsules. This angular spacing $\beta$ is, consequently, equal to half the angle $\beta$ previously mentioned.

When the munition disk 6 is placed upon the barrel 2, each projection 9 is engaged in a respective seat 3 of the barrel 2 to one side or the other of the anvil 4 of this seat. In FIG. 4, for example, the projections 9 are disposed to the counterclockwise side of the respective projections.

In this position of the munition disk, half of the capsules 8 are axially aligned with the anvils 4, (i.e. every other capsules is disposed between the anvils of successive seats. The revolver is operated to fire these twelve capsules axially aligned with the respective anvils by one full rotation of the disk. The disk need not be altered in position on the barrel during this firing operation.

In order to fire the remaining capsules, all that is necessary is to withdraw the projections 9 from their respective seats, displace them clockwise relative to the barrel 2 and reengage them in the same seats but on the opposite side of the anvil 4. To this end, the disk is displaced relative to the barrel through an angle $\gamma$. So that the capsules 8 which remained unfired after the first operation can be fired by the hammer subsequent to this angular displacement of the disk, it is desirable that the angle $\gamma$ be equal to the angle $\gamma$ and, consequently, that the thickness of a projection 9 plus the diameter of an anvil 4 be equal to the angular spacing between two neighboring capsules. Furthermore, the radial dimension of each projection 9 is such that the projection 9 engages in the seat 3 along a chord in contact with two generatrices thereof but is tangent to the anvil 4 and hence engages the latter along a generatrix of the anvil. The two small sides of each projection 9 are in slidable but tight-fitting contact with the cylindrical internal face of the respective seat 3.

The munition of the present invention allows twice as many firings to be obtained than classical disk munitions without requiring a special pistol construction and any extended manipulation.

I claim:

1. A munition disk for a toy revolver having a barrel provided with a plurality of angularly equispaced recessed seats and an anvil disposed centrally in each of said seats, said disk being formed with a multiplicity of angularly spaced explosive-charge capsules of a number twice that of the seats of said revolver and being engageable with said barrel, one of the faces of said disk being percussible to fire successive capsules, the opposite face of said disk being provided with at least two projections engageable in respective ones of said seats to one side or the other of the respective anvil, said capsules being dimensioned such that alternate capsules are axially aligned with said anvils when said projections lie to one side of the anvils in the seats in which said projections are received and the remaining capsules are axially aligned with said anvils when said projections lie to the opposite sides of the anvils of the seats in which the projections are received, and a pair of disk elements, one of said disk elements being formed along a face with a plurality of angularly equispaced recesses of identical depth receiving respective explosive charges adapted to form said capsules, and being provided with said projections on an opposite face of said one of said disk elements, the other of said disk elements closing said capsules along said one of said faces of said one of said disk elements, all of the capsules on the disk being identical, said other of said disk elements being composed of a thin sheet, said one of said disk elements being thicker than said other of said disk elements.

2. The munition disk defined in claim 1 wherein at least one of said disk elements is composed of a thermally weldable material.

3. The munition disk defined in claim 1 wherein the diameters of said capsules are at most slightly greater than that of said anvils.

4. The munition disk defined in claim 3 where each of said projections has a width such that added to a radius of an anvil it corresponds to the angular spacing of two neighboring capsules, the radial dimensions of each of said projections being such that it is engaged forcibly in the respective seat in which it is received, each of said projections being disposed between two neighboring capsules.

5. A firing assembly for a toy revolver comprising:

a rotatable barrel formed with a plurality of angularly equispaced concave seats at one end of said barrel, and respective anvils projecting toward said end of said barrel centrally with each of said seats; and a munition disk receivable on said end of said barrel, said munition disk comprising a first disk element having a first face formed with a plurality of angularly equispaced recesses opening at said first element, a plurality of explosive charges received in said recesses, and a second disk element closing said recesses and bonded to said first disk element along said one of said faces, the opposite face of said one of said elements being formed with a plurality of radially elongated axially extending projections, each of said projections being disposed between two recesses and receivable snugly in a respective one of said seats to one side or the other of the respective anvil, said recesses and the respective explosive charges defining respective cylindrical capsules having diameters at most slightly greater than the diameters of said anvils the thickness of said projections, added to the radius of an anvil corresponding to the angular spacing of two neighboring capsules.

* * * * *